US006406406B1

(12) United States Patent
Onorati

(10) Patent No.: US 6,406,406 B1
(45) Date of Patent: Jun. 18, 2002

(54) HAND AND WRIST EXERCISER

(76) Inventor: Memmo J. Onorati, 306 Ryan's Run, W., Maple Shade, NJ (US) 08052

( * ) Notice: Subject to any disclaimer, the term of this patent is extended or adjusted under 35 U.S.C. 154(b) by 0 days.

(21) Appl. No.: 09/688,916

(22) Filed: Oct. 16, 2000

(51) Int. Cl.[7] ..... A61F 5/02

(52) U.S. Cl. ..... 482/44; 482/45; 482/49; 601/40

(58) Field of Search ..... 482/44, 45, 46, 482/47, 48, 49, 121, 122, 126, 148, 908; 601/23, 33, 40

(56) References Cited

U.S. PATENT DOCUMENTS

| | | | | |
|---|---|---|---|---|
| 1,495,278 A | * | 5/1924 | Titus | |
| 1,877,218 A | * | 9/1932 | Blank | |
| 3,539,182 A | * | 11/1970 | Sieg et al. | 272/68 |
| 3,570,849 A | | 3/1971 | Ratchford | 272/68 |
| 3,592,467 A | | 7/1971 | Pereira | 272/83 |
| 4,226,412 A | | 10/1980 | Panepinto | 272/68 |
| 4,239,212 A | * | 12/1980 | Hickey | 482/126 |
| 4,553,746 A | | 11/1985 | Lee | 272/68 |
| 5,125,878 A | | 6/1992 | Wingate | 482/49 |
| 5,133,544 A | | 7/1992 | Patik | 482/49 |
| 5,222,925 A | | 6/1993 | Maycock | 482/44 |
| 5,611,755 A | | 3/1997 | Blackmore | 482/49 |
| 5,711,747 A | | 1/1998 | Steinback | 482/124 |

OTHER PUBLICATIONS

Simplegolf.net Grip Master see, attached.

* cited by examiner

*Primary Examiner*—Jerome W. Donnelly
*Assistant Examiner*—Tam Nguyen
(74) *Attorney, Agent, or Firm*—John H. Scarborough; Robert R. Mallinckrodt

(57) ABSTRACT

A hand and wrist exerciser having an outer frame comprising left and right outer posts, upper and lower members connected to the left and right outer posts, and intermediate portion, configured such portion at an angle of less than 180 degrees with respect to the upper and lower members forming an arch thereby. The upper member has slots on the lower side thereof and the lower member has slots on the upper side thereof. A pair of gripping posts, slidably connected to the upper and lower members, have bars inserted therethrough which enable the gripping posts to slide toward the outer posts in one direction. Tension springs, located within the upper and lower members, hold each of the gripping posts toward the intermediate portion. This enables a user to place fingers around a gripping post with the base of the thumb held against an outer post and squeeze the gripping post toward the outer post for one exercise; then place the fingers of each hand between a gripping post and an outer post and move the hand wrist exerciser back-and-forth in a horizontal direction for another exercise. In one embodiment, the tension of the tension springs can be adjusted with adjusting screws located on both the upper and lower members.

12 Claims, 15 Drawing Sheets

HAND AND WRIST EXERCISER

BACKGROUND OF THE INVENTION

1. Field

This invention relates in general to hand and wrist exercisers and, more particularly, to a finger exerciser and inner-forearm strengthener and a wrist and inner-forearm stretcher.

2. Background of the Invention

Arthritis can be caused by any number of reasons, such as degeneration of the joints. Carpel tunnel syndrome can occur because of injury to the wrist or because of repetitive operations such as typing on a computer keyboard. With the recent use of personal computers in the home and at the work place, carpel tunnel syndrome is occurring more and more. The purposes of this invention are to reduce and prevent the symptoms both of arthritis and of carpel tunnel syndrome.

With regard to arthritis, exercise and physiotherapy is important in maintaining range of motion of affected joints. When inflammation has subsided, active exercise can be used to maintain muscle strength and range of motion. A gripping movement wherein the fist is opened and closed increases the mobility of the fingers.

With regard to carpel tunnel syndrome, surgical relief may be indicated if conservative therapy fails. Bending the fingers backwards away from the palms stretches the wrist and inner forearm. This exercise can relieve symptoms and is helpful in preventing the onset of carpel tunnel syndrome.

3. State of the Art

Wingate, et al., U.S. Pat. No. 5,125,878, and Ratchford, U.S. Pat. No. 3,570,849, provide hand and finger exercising devices similar to the instant invention. In both Wingate and Ratchford, tension is provided by a series of rubber bands; the tension can be adjusted by adding or removing rubber bands; however both devices can be operated by only one hand at a time. In the instant invention, tension is provided by springs, in another embodiment, the tension of each spring can be adjusted by means to extend the spring or by means to lengthen or shorten that part of each spring which provides tension. The instant invention also can be operated by both hands. Further, the instant invention provides a means to stretch the wrists and inner forearms.

Panepinto, U.S. Pat. No. 4,226,412, provides a hand exerciser comprised by two cooperating U-shaped members in which tension is provided by springs; however, the device can only be operated by one hand at a time. The purpose of the invention is to prevent said cooperating members from binding and jamming. It provides no means to stretch the inner wrist, and it does not provide for a means to adjust the tension of the springs.

Lee, U.S. Pat. No. 4,553,746, provides a hand exerciser in which tension is provided by springs, but the hand exerciser is operated by only one hand at a time. Lee provides no means to stretch the inner wrist. Lee does provide for a means to adjust the tension of the springs; however, the construction of Lee's device is much more complex than the construction of the instant invention.

In Blackmore, U.S. Pat. No. 5,611,755, the apparatus is similar to the instant invention in appearance; however, there is no means to provide and adjust tension for gripping; gripping tension is merely provided by one hand working against the other hand. Blackmore provides no means to stretch the wrists.

Maycock et al., U.S. Pat. No. 5,222,925, discloses a device for exercising and stretching the wrist, but provides no means to exercise the grip of the fingers.

Other inventions, Steinback, U.S. Pat. No. 5,711,747, Patik, U.S. Pat. No. 5,133,544, and Pereira, U.S. Pat. No. 3,592,467, do not focus on the hand and wrist exercising as do other prior art cited herein.

None of the prior art provides a hand and wrist exerciser where tension is provided by springs; where the tension of springs can be adjusted; and where either hand or both hands can operate the device simultaneously. Moreover, the unique shape of the instant invention makes possible its use both as an exerciser to strengthen the grip and as an exerciser to stretch the wrist and inner forearms.

OBJECTS OF THE INVENTION

The primary object of this invention is to provide a device which both can exercise and strengthen the fingers and inner-forearms and can stretch the wrists and inner-forearms.

Another object of this invention is to provide a hand and wrist exerciser in which tension is provided by springs, and the tension of the springs can be adjusted.

SUMMARY OF THE INVENTION

In the instant invention, an outer frame has an upper member and a lower member plus two outer posts. Two posts parallel to the outer posts slidably connected to the upper and lower members serve as gripping posts for fingers when the invention is used as a finger exerciser and inner-forearm strengthener and serve as braces for the fingers while the back of the hand is held against the outer posts when the invention is used as a wrist and inner-forearm stretcher. The shape of the hand and wrist exerciser is particularly adapted to function as both a finger exerciser and inner-forearm strengthener and a wrist and inner-forearm stretcher. Two 45° corners are formed along both the upper and lower members. When viewed from the top (and bottom) the upper (and lower) members form an arch which resemble three sides of a trapezoid. This particular shape provides comfort when the invention is used as a finger exerciser and inner-forearm strengthener and makes possible for this device to be used as a wrist and inner-forearm stretcher.

In one embodiment, springs attached to a pin inside the upper and lower members and to a metal bar inserted in the gripping post provide tension when the invention is used as a finger-gripping exerciser. In a second embodiment, bolts or screws inserted through the upper and lower members near the corners thereof are employed to adjust the tension of the springs when the invention is used as a finger-gripping exerciser.

BRIEF DESCRIPTION OF THE DRAWINGS

The best mode presently contemplated for carrying out the invention in actual practice is shown in the accompanying drawings, in which.

DETAILED DESCRIPTION OF THE ILLUSTRATED EMBODIMENT

How to Make

Figure 1:
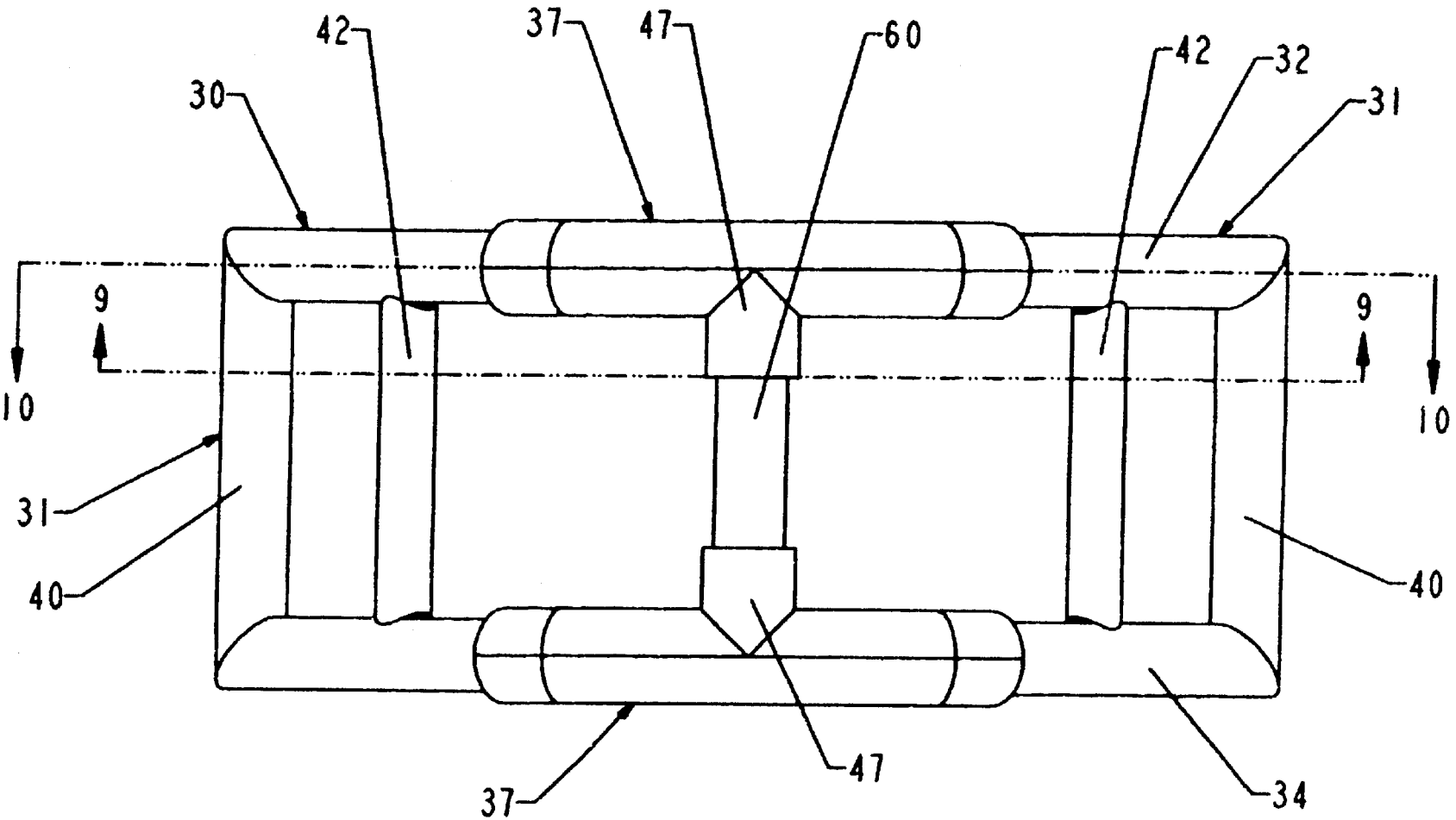
FIG. 1 is a front elevation of the hand and wrist exerciser.
Figure 10:
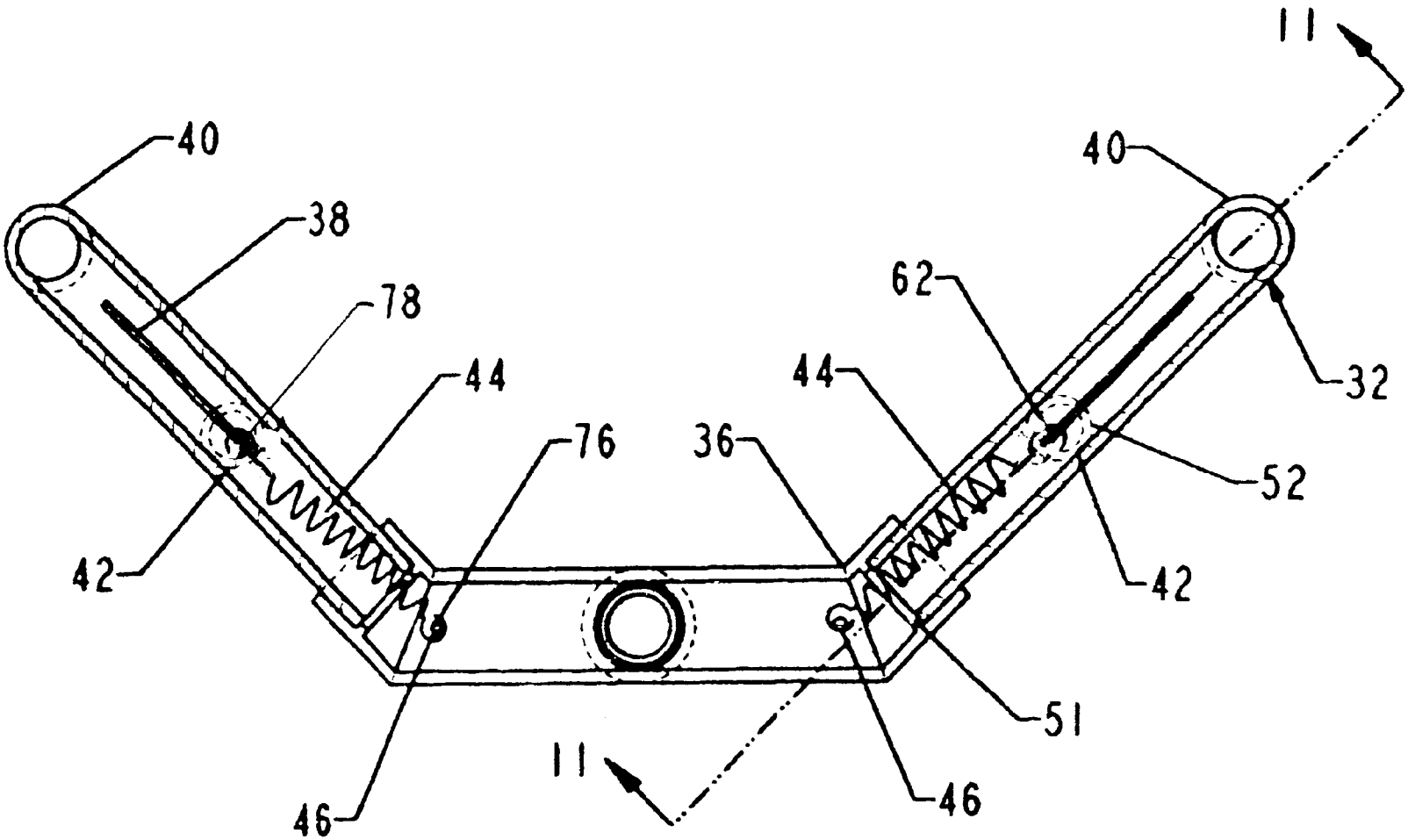
FIG. 10 is a cross section of the upper member of the hand and wrist exerciser taken along 10—10 of FIG. 1.
Figure 11:
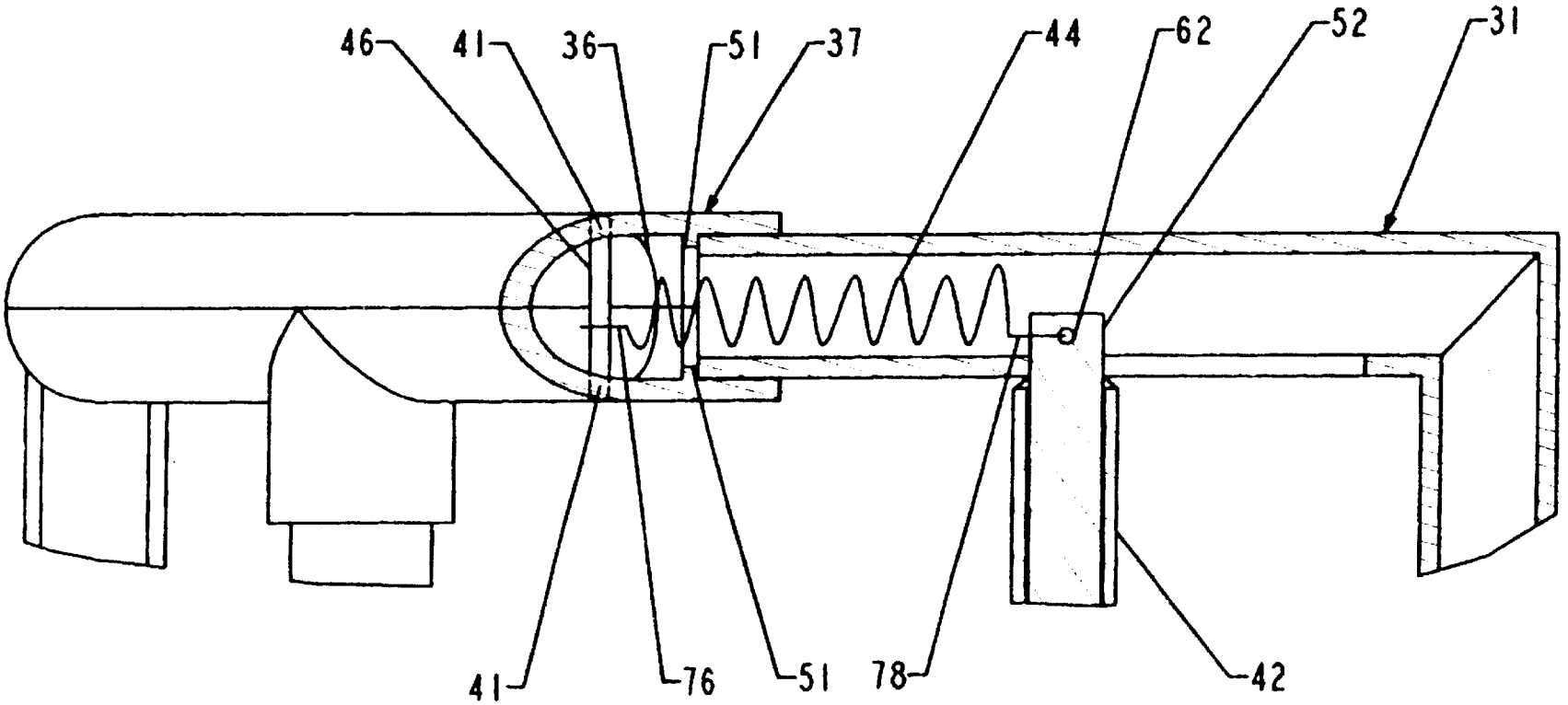
FIG. 11 is a partial cross section of an upper member of the hand and wrist exerciser taken along 11—11 of FIG. 10.
Figure 12:
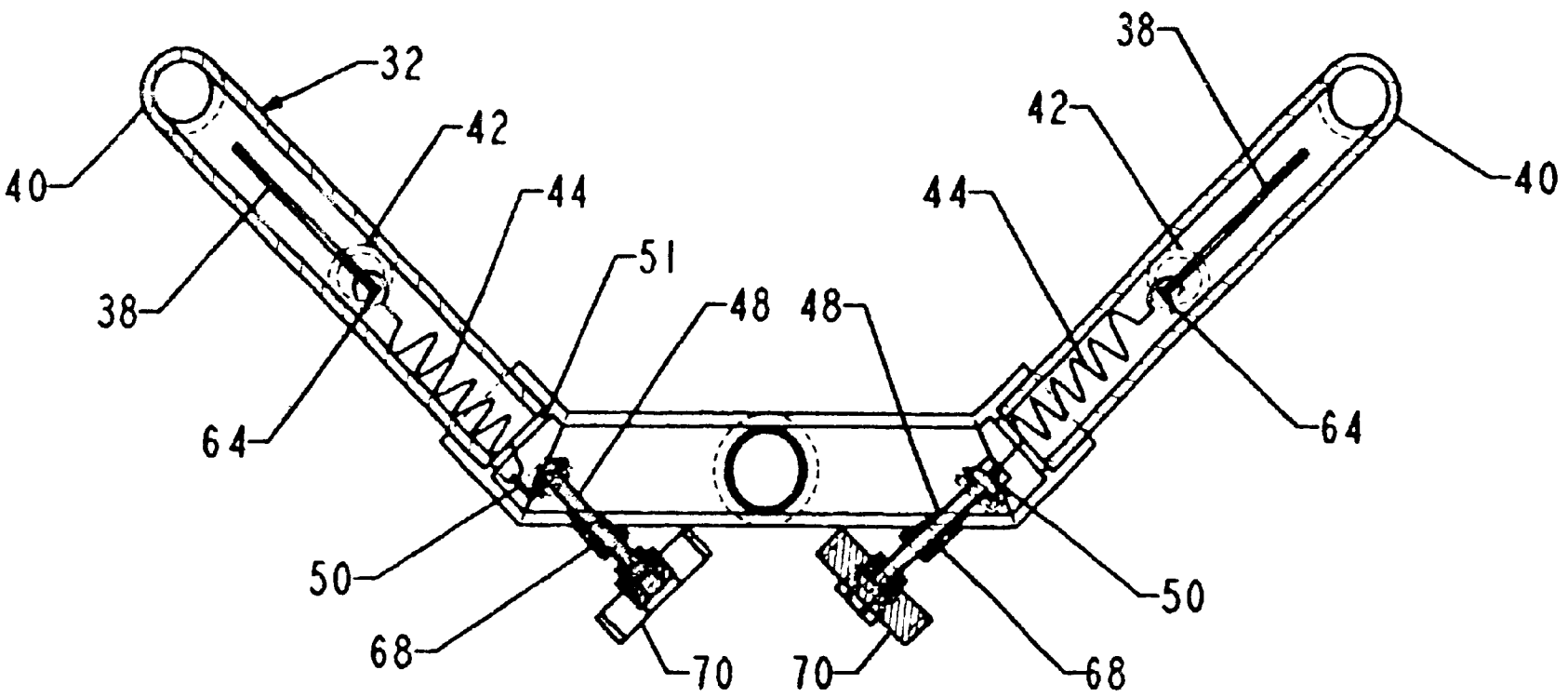
FIG. 12 is a cross section of the upper member of the second embodiment taken along 12—12 of FIG. 5.
Figure 13:
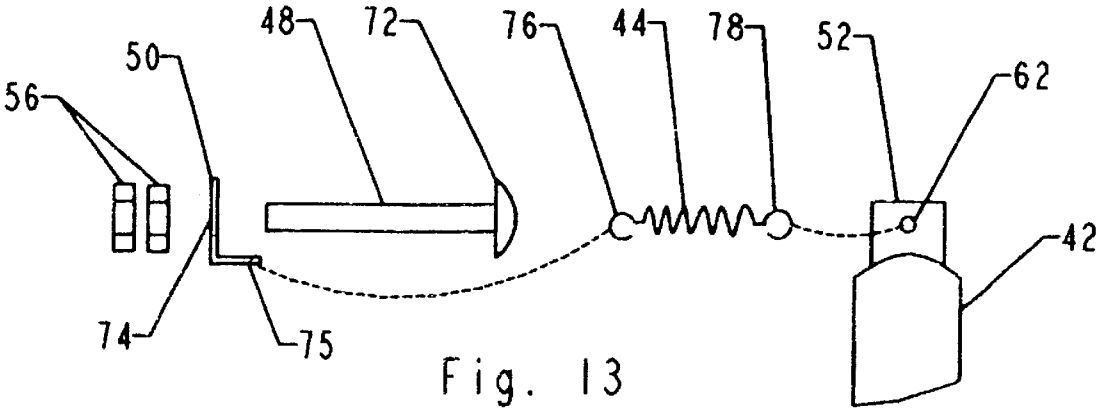
FIG. 13 is an exploded view of the tension adjusting mechanism as shown in FIG. 12.
Figure 14:
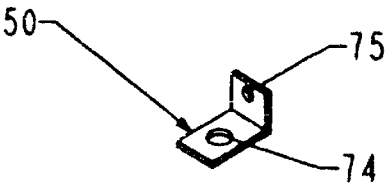
FIG. 14 is a perspective view of the small stamped sheet-metal angle shown in FIG. 13.

In the illustrated embodiment, FIG. 1 shows the hand and wrist exerciser. A rigid outer frame 30 forms an upper member 32, a lower member 34, and two outer posts 40, FIG. 1. The outer frame 30 is constructed of two U-shaped end sections 31 and two 90° tees 37, FIG. 1. Each end section 31 comprises ¾" O.D. (outer diameter) polyvinyl chloride (hereinafter, PVC) tubing having two 90° corners 35, FIG. 2. The end sections 31 are inserted into tees 37, FIG. 1, up to stopping ribs 51 inside the arms 43 of the tees 37 which are shown in FIGS. 10–12. The end sections can be formed by injection molding as a single piece individually or may be formed by cutting and mitering sections of PVC tubing and gluing said sections together at the corners thereof.

Figure 3:
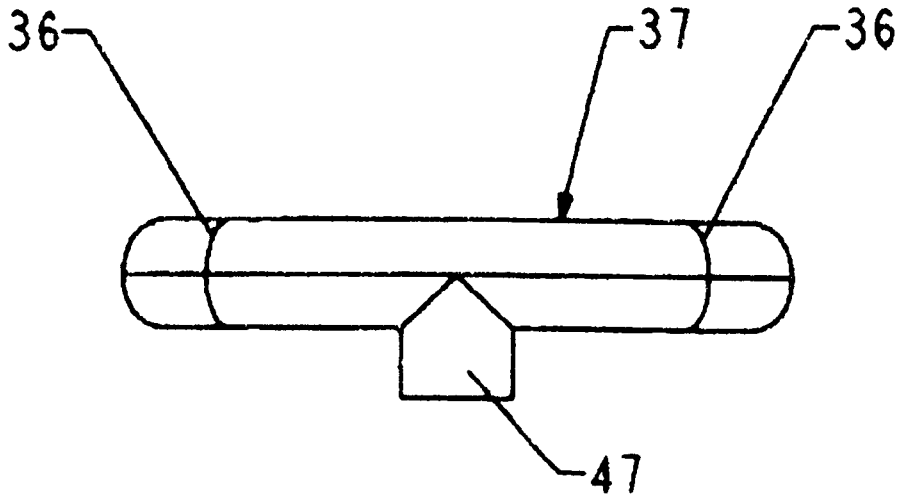
FIG. 3 is a front elevation of a tee-section which forms a part of the hand and wrist exerciser.
Figure 4:
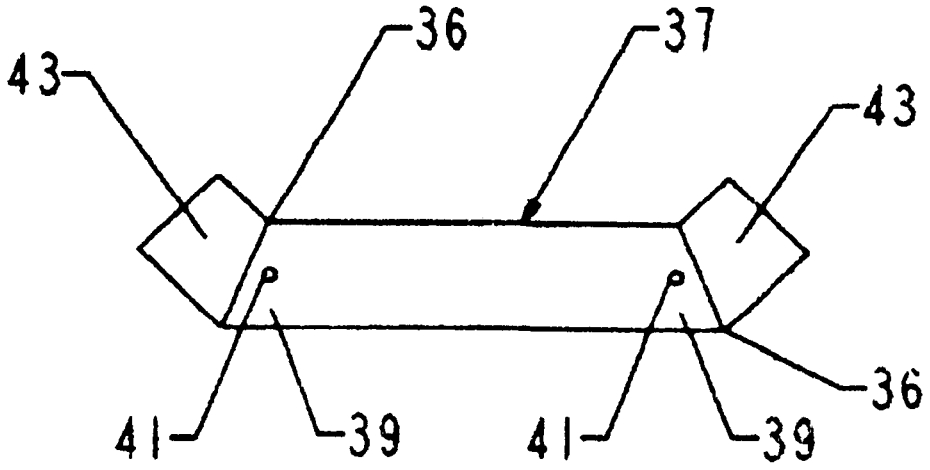
FIG. 4 is a top plan view of the tee-section.
Figure 5:
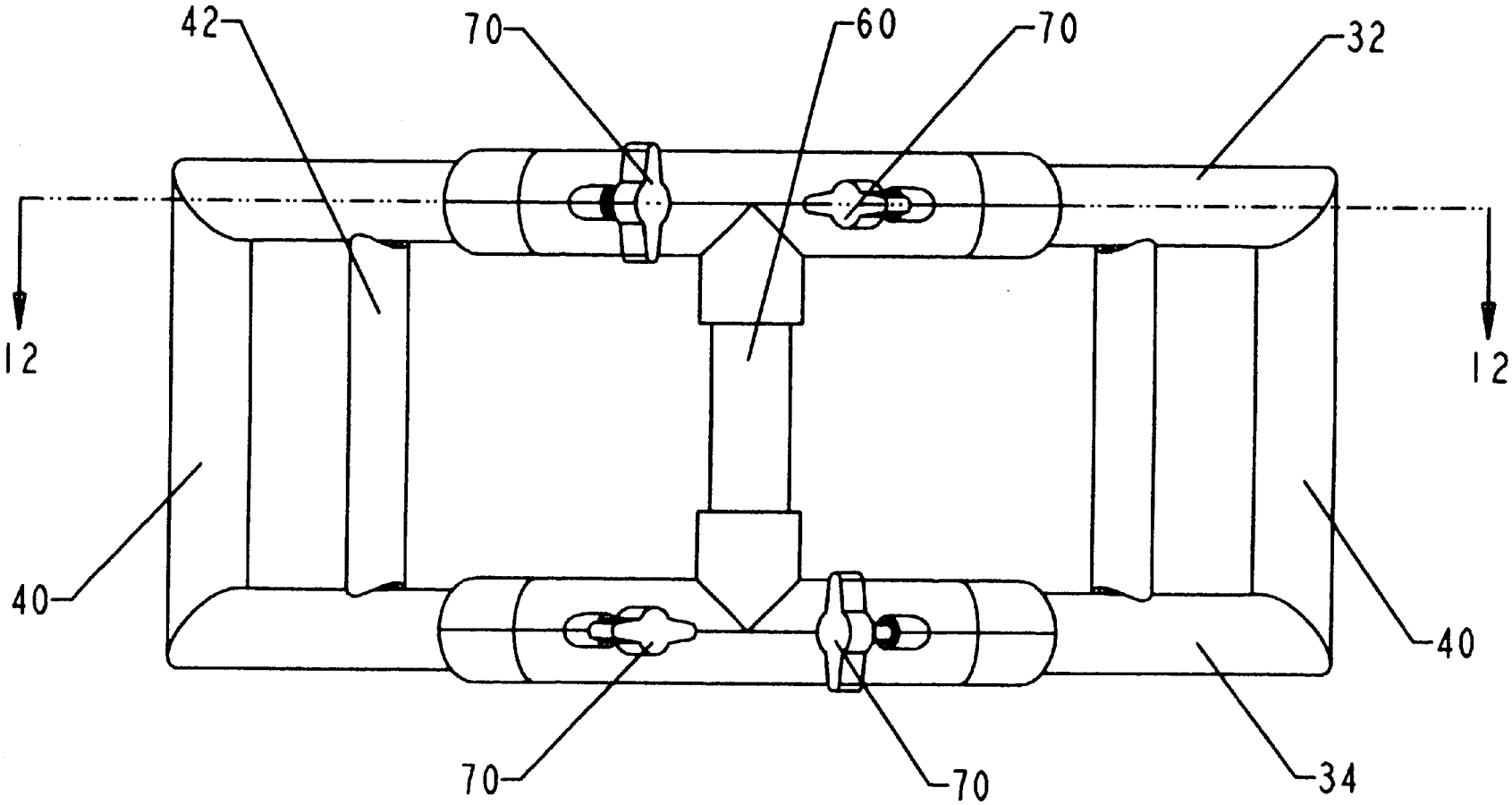
FIG. 5 is a front elevation of a second embodiment of the hand and wrist exerciser wherein the tension of the springs may be adjusted.

Each 90° tee 37 is comprised of ¾" I.D. (inside diameter) PVC tubing having arms 43 attached to the ends of shoulders 39 forming 45° corners 36 to said shoulders, FIGS. 3 and 4, and a trunk 47 as shown in FIGS. 1 and 4. It is primarily contemplated that the tees be formed into single units by injection molding. However, the tees can be formed by cutting, mitering, and gluing individual pieces of ¾" I.D. PVC tubing, forming arms 43, to the shoulders of the tee 37 as shown in FIGS. 3 and 4. Or, the tees can be formed by attaching two 45° elbows together with trunk 47, not shown.

A stabilizing post 60, a ¾" O.D. piece of PVC tubing is placed within and connected to the trunk 47 of each of the 90° tees 37, FIGS. 1 and 3, parallel to the outer posts 40 and perpendicular to the upper 32 and lower 34 members, to help maintain the rigidity of the outer frame.

Figure 2:
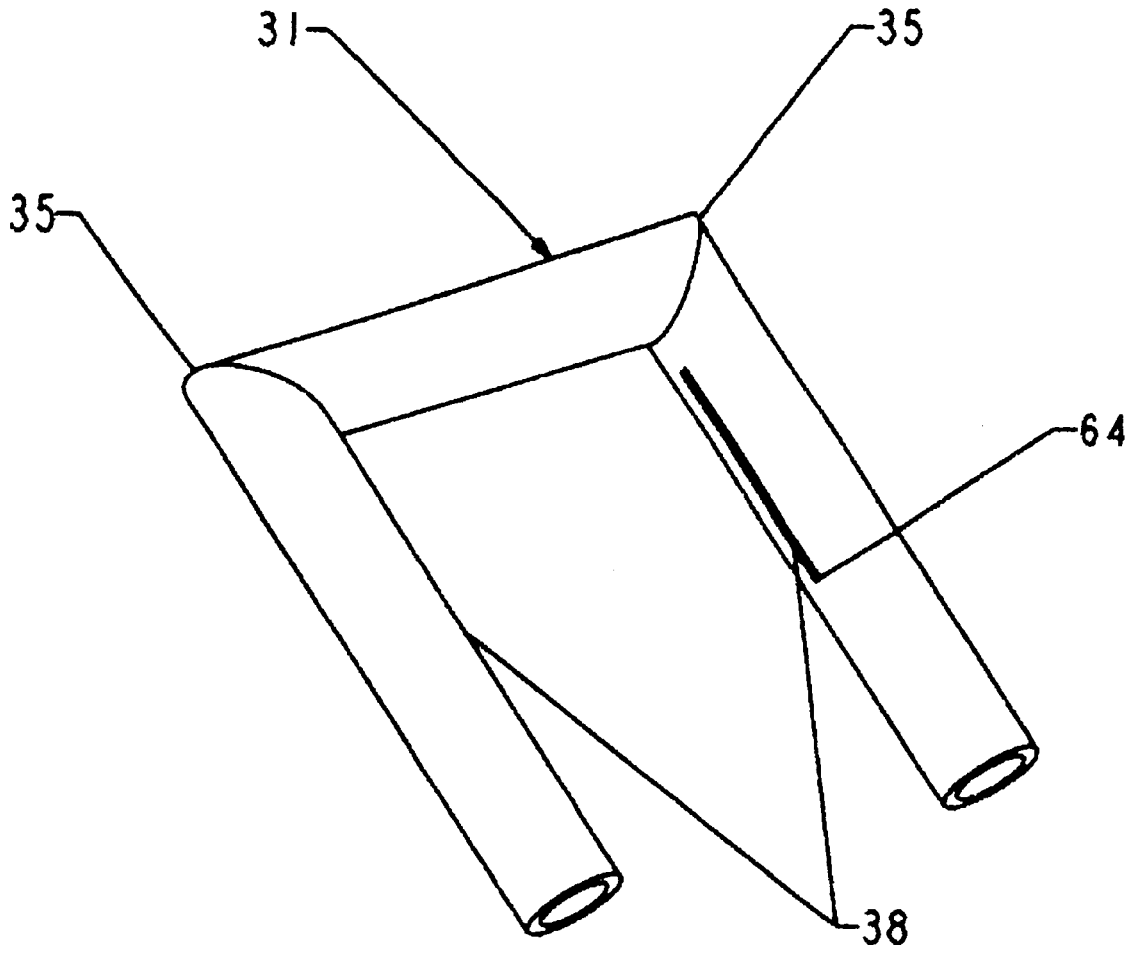
FIG. 2 is a perspective view of a U-shaped end section which forms a part of the hand and wrist exerciser.
Figure 6:
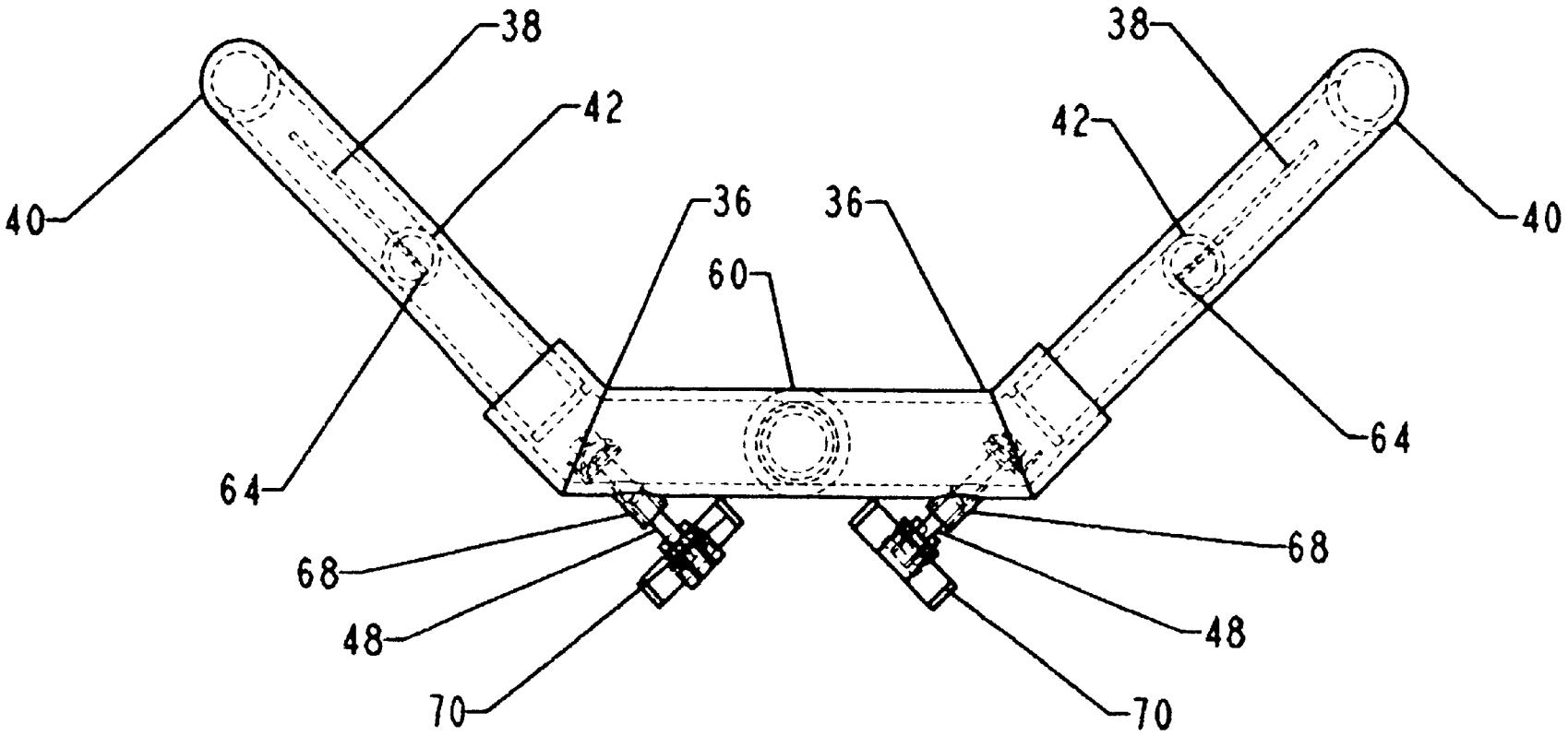
FIG. 6 is a top plan view of the second embodiment as shown in FIG. 5.
Figure 8:
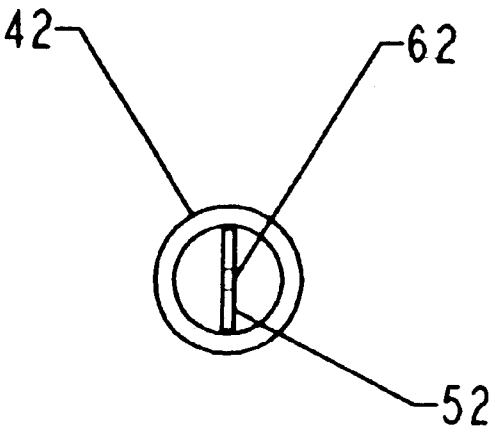
FIG. 8 is a side elevation of the gripping bar as shown in FIG. 7.
Figure 7:
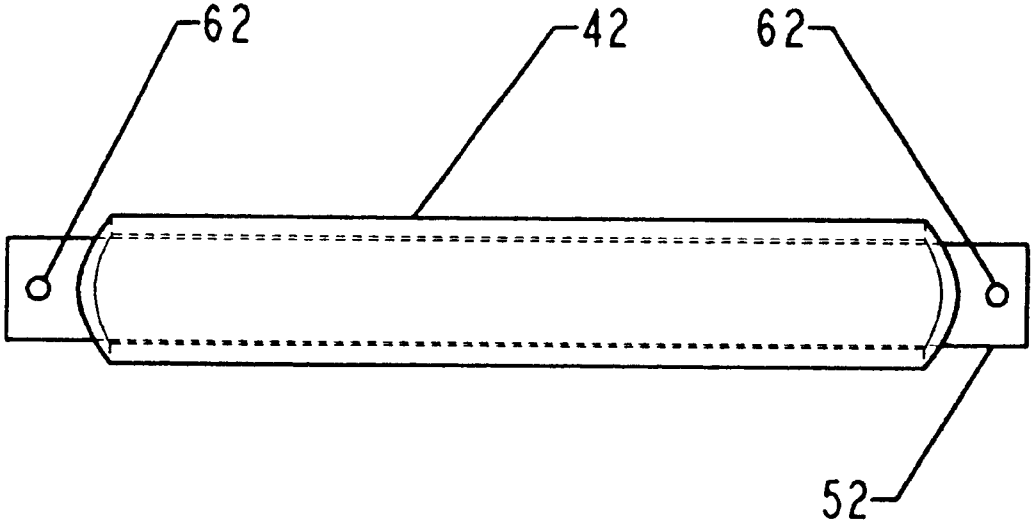
FIG. 7 is a front elevation of a gripping bar.

To complete the structure of the hand and wrist exerciser, two gripping posts 42 are placed, perpendicularly to the upper 32 and lower 34 members, each between a stabilizing post 60 and an outer post 40, parallel to both the stabilizing post 60 and the outer posts 40, FIG. 1. Each gripping post 42 is comprised of a ¾" O.D. PVC cylinder into which a rectangular metal gripping post bar 52 is inserted, FIGS. 7 and 8. Holes 62 are drilled into the ends of the gripping post bar 52 as shown in FIGS. 7 and 8. The ends of bars 52 are slidably inserted into slots 38 of the upper 32 and lower 34 members to enable the gripping posts 42 to slide along the upper 32 and lower 34 members from an end point 64, as shown in FIGS. 2 and 6, to the outer posts 40.

Figure 9:
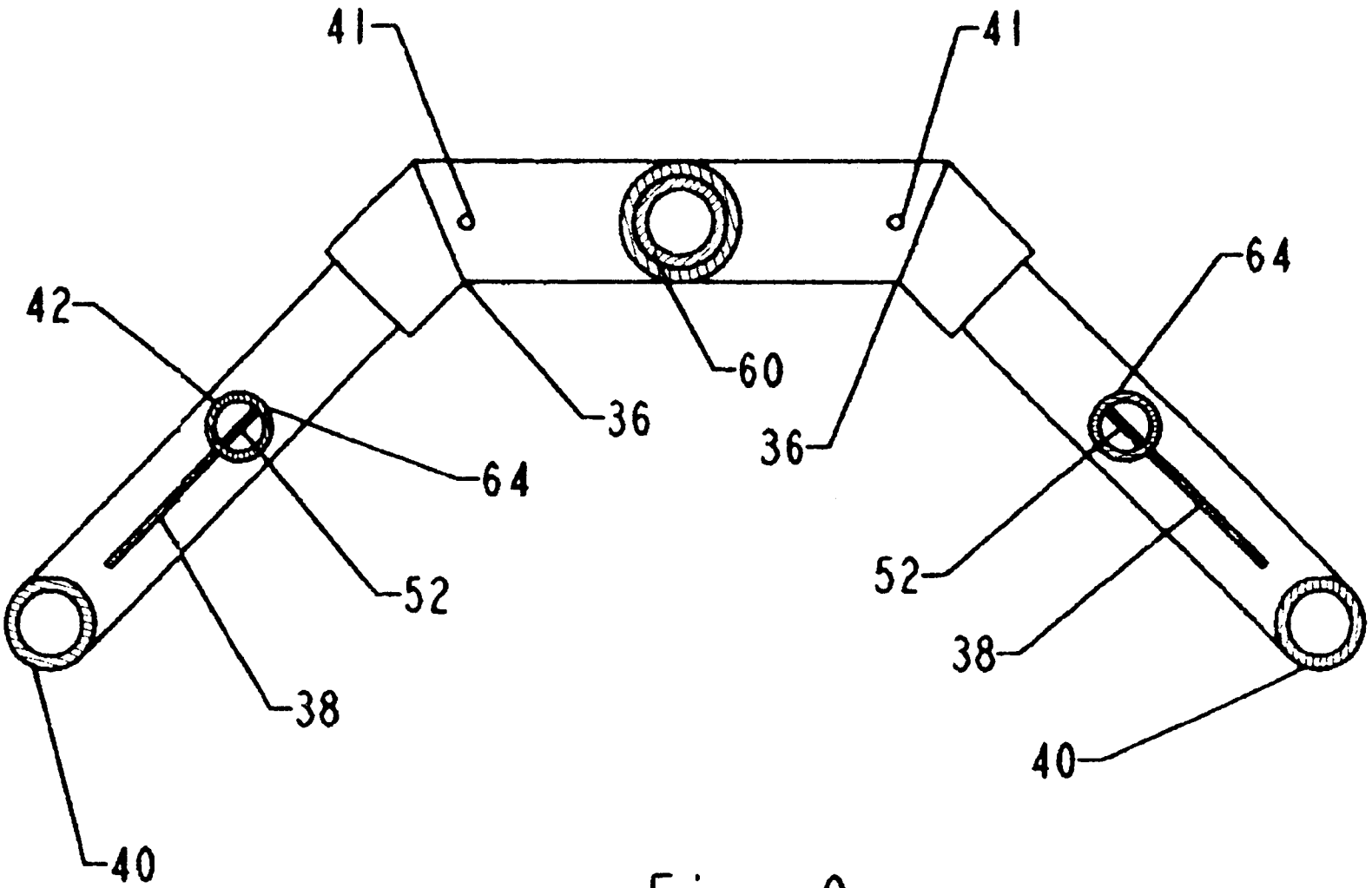
FIG. 9 is a section showing the underneath of the upper member (or the top of the lower member) of the outer frame of the hand and wrist exerciser taken along 9—9 of FIG. 1.

An intermediate portion of the outer frame is defined as that part of both the upper member and lower member between the corners 36 thereof, FIGS. 9 and 10. When viewed from the top, FIG. 9, such intermediate portion forms an arch in the upper member and in the lower member. The purpose of this unique shape is to enable the hand and wrist exerciser to operate as an exerciser to strengthen the grip and as an exerciser to stretch the wrist and inner forearms. When used as an exerciser to strengthen the grip the fingers are placed around the gripping post 42 while the base of the thumb is held against an outer post 40, FIG. 1. Because of the arch formed in the outer frame, the effective horizontal distance between the outer posts and the gripping posts is made smaller; therefore, for using the exerciser as a wrist and inner arm stretcher, the fingers of each hand can be placed between the gripping post and outer post and the hand and wrist exerciser moved back-and-forth in a horizontal direction.

Gripping posts are biased toward the intermediate portion by means of tension resistance, and such tension resistance is accomplished by employing springs. In the first embodiment, two tension springs are placed within the upper member 32 as shown in FIG. 10. One end 78 of each tension spring 44 is hooked into a hole 62, FIGS. 10 and 11, of a gripping post bar 52; the other end 76 of the tension spring 44 is hooked around a pin 46 within the tee 37 of upper member 32, FIG. 10. Each pin 46 is comprised of a dowel, wood or plastic, approximately ⅛" O.D. and inserted into the 90° tees 37, FIGS. 10 and 11, of both upper 32 and lower 34 members through holes 41 of appropriate size drilled into the 90° tees 37 near the corners 36, FIGS. 4, 10, and 11, thereof. FIG. 11 shows the tension spring 44 mounted inside upper member 32. One end 76 of spring 44 is connected to pin 46 and the other end 78 is connected to the gripping post bar 52 through hole 62, FIG. 11. The lower member 34 is the exact mirror image of the upper member 32, FIGS. 1, 5, 9–12, and 24.

Tension springs 44 create force in the gripping posts 42 against the fingers when the gripping posts 42 are pulled toward the outer posts 40, FIGS. 10 and 12. As each gripping post 42 moves toward the outer post 40, the gripping post bar 52, inside gripping post 42, slides along slot 38, FIGS. 2, 6, 9, 10, and 12, until the gripping post 42 comes in contact with outer post 40, FIG. 20. When the gripping posts 42 are released, the gripping posts 42 are made to stop when the edges of gripping post bar 52 come in contact with end points 64 of slots 38 FIGS. 2, 6, 9, 10, and 12.

Figure 24:
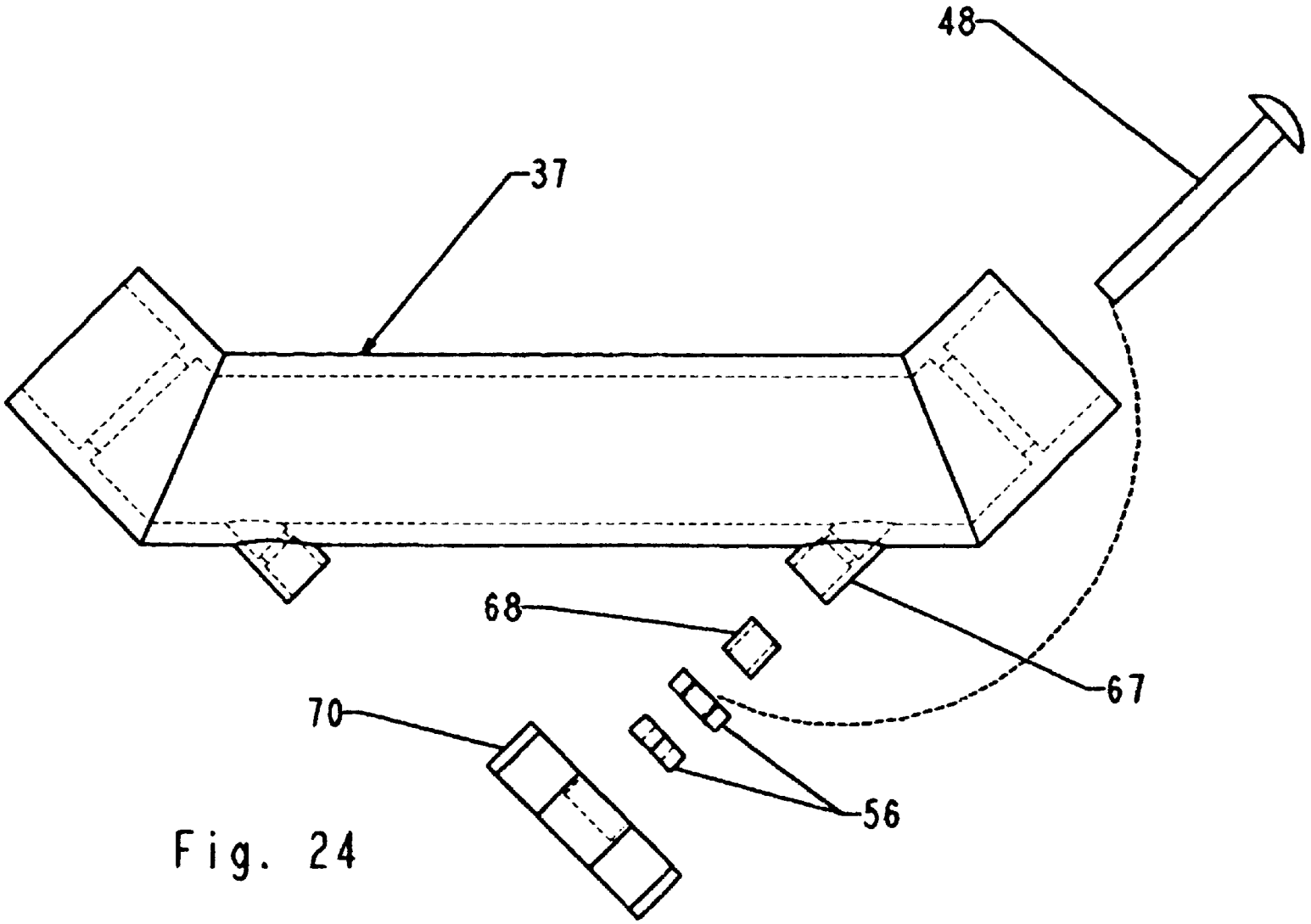
FIG. 24 is an exploded view showing an insert molded into a tee and a turning knob fitted over locking nuts which have been screwed onto the tension adjusting screw.

Adjusting the tension on the springs characterizes a second embodiment of this invention, FIGS. 5, 6, and 12–19. In the second embodiment, screws 48 fit into the tees 37 of the upper and lower members through inserts 68, which have internal threads, FIGS. 12 and 24. Inserts 68 having a knurled, irregular outer surface, such as barbs, are either molded into or pressed into small plastic (PVC) sleeves 67 on the tees 37 as shown in FIG. 24. Sleeves 67 either are formed as part of the outer surface of the tee if the tees are formed by injection molding or can be PVC tubing cut, mitered, and glued onto the outer surface of the tee. Knobs 70 are attached to the outer end of the screw 48, FIG. 5, 6, and 12; locking nuts 56 form a nub over which the turning knobs 70 fit, FIG. 24. In a first version of the tension adjusting mechanism, each screw 48 fits through a small stamped sheet-metal angle 50 at hole 74, FIGS. 13 and 14. Screw 48 is inserted through hole 74, of sheet-metal angle 50, so that angle 50 is positioned between locking nut 56 and screw head 72 of the screw 48, FIG. 13. The hook of one end 76 of tension spring 44 is inserted through the other hole 75 of angle 50, FIGS. 13 and 14. The hook of the other end 78 of tension spring 44 is inserted into a hole 62 of a gripping post bar 52, FIG. 13, which has been inserted through a gripping post 42. Assuming that screw 48 has a right-hand-screw orientation, when the screw 48 is turned counter-clockwise, tension spring 44 is stretched and extended and the tension thereon is increased. When the screw 48 is turned clockwise, tension spring 44 is released and shortened and the tension thereon is decreased.

Figure 15:
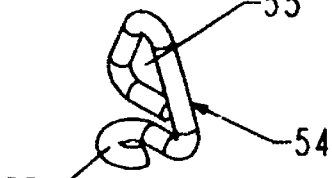
FIG. 15 is the perspective view of the swivel as shown in FIG. 16.
Figure 16:
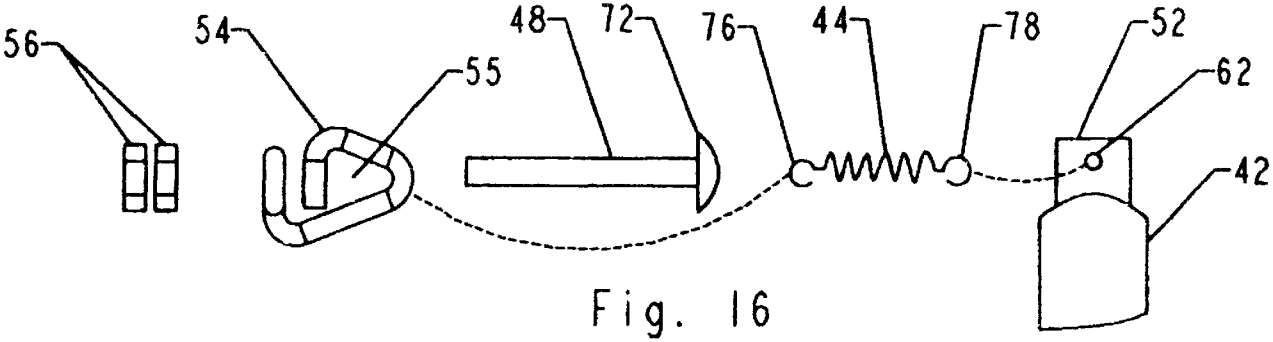
FIG. 16 is an exploded view of a second version of the tension adjusting mechanism.

In a second version of the tension adjusting mechanism, the sheet-metal angle is replaced by a swivel 54, FIGS. 15 and 16. The screw head 72 of each screw 48 being larger than ring 57 of the swivel 54, FIGS. 15 and 16, to prevent the swivel 54 from becoming separated from the screw 48. The hook of one end 76 of tension spring 44 is inserted through the loop 55 of swivel 54, FIGS. 15 and 16. The hook of the other end 78 of tension spring 44 is inserted into hole 62 of gripping post bar 52, FIG. 16, which has been inserted into a gripping post 42. Assuming that screw 48 has a right-hand-screw orientation, when the screw 48 is turned counter-clockwise by the user turning knob 70 counter-clockwise, tension spring 44 is extended and the tension thereon is increased; when the screw 48 is turned clockwise, tension spring 44 is shortened and the tension thereon is decreased.

Figure 18:
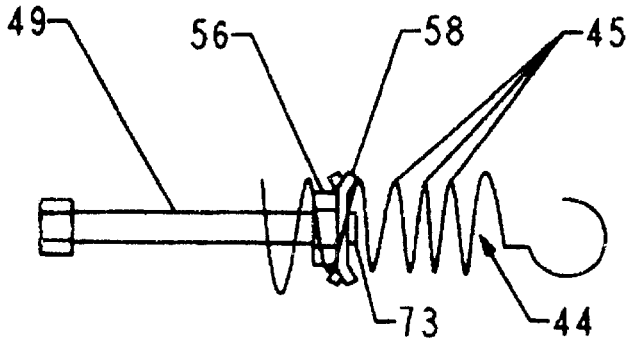
FIG. 18 is a front elevation of the third version of the tension adjusting mechanism showing the tension adjusting plate engaging the coils of the tension adjusting bolt.
Figure 19:
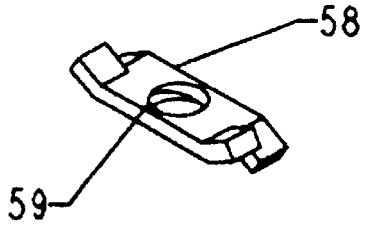
FIG. 19 is a perspective view of the tension adjusting plate.
Figure 17:
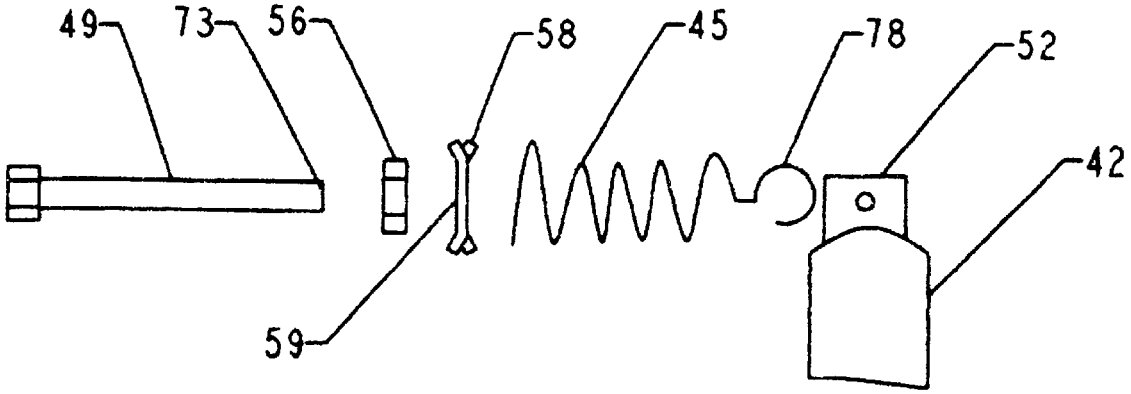
FIG. 17 is an exploded view of a third version of the tension adjusting mechanism.

In a third version of the tension adjusting mechanism, a tension adjusting plate 58 is attached to the inner end 73 of each bolt 48 as shown in FIG. 17. The tension adjusting plate is constructed of sheet metal formed as shown in FIG. 19 with a threaded hole 59. The tension adjusting plate 58 is held in place on a hexbolt 49 by locking nut 56 screwed and abutted thereto, FIGS. 17 and 18. The tension adjusting plate can also be held in place on the hexbolt 49 by placing locking nuts on both sides of the tension adjusting plate, not shown, or by welding the tension adjusting plate to the hexbolt 49, also not shown. The hook of one end of tension spring 44 is removed to allow the tension adjusting plate 58 slide rotatably through the coils of the tension spring 44 as shown in FIG. 18. By turning hexbolt 49, the tension adjusting plate 58 can be threaded through the coils 45 of the tension spring 44, FIG. 18. Repositioning the tension adjusting plate through the coils of the tension spring changes the length of the tension spring which can be stretched. Reducing the length of spring to be stretched dramatically increases the force required to stretch and extend the tension spring. For a hexbolt and spring having a right-hand-screw orientation, as the hexbolt 49 is turned clockwise, the effective length of the tension spring 44 is shortened thereby requiring greater tensile strength to stretch the tension spring 44. When the hexbolt 49 is turned counter-clockwise, the effective length of tension spring 44 is lengthened and the tension thereof is decreased.

The purpose of the first and second versions of the tension adjusting mechanism is for the treatment of the symptoms of arthritis. As the grip becomes stronger, the tension can be adjusted moderately to make the fingers more mobile and the finger joints more supple. The purpose of the third version of the tension adjusting mechanism is for heavy exercise to strengthen fingers, wrists, and forearms. With the third version, the change in tension is much more dramatic than that of the first and second versions of the tension adjusting mechanism.

How to Use

Figure 20:
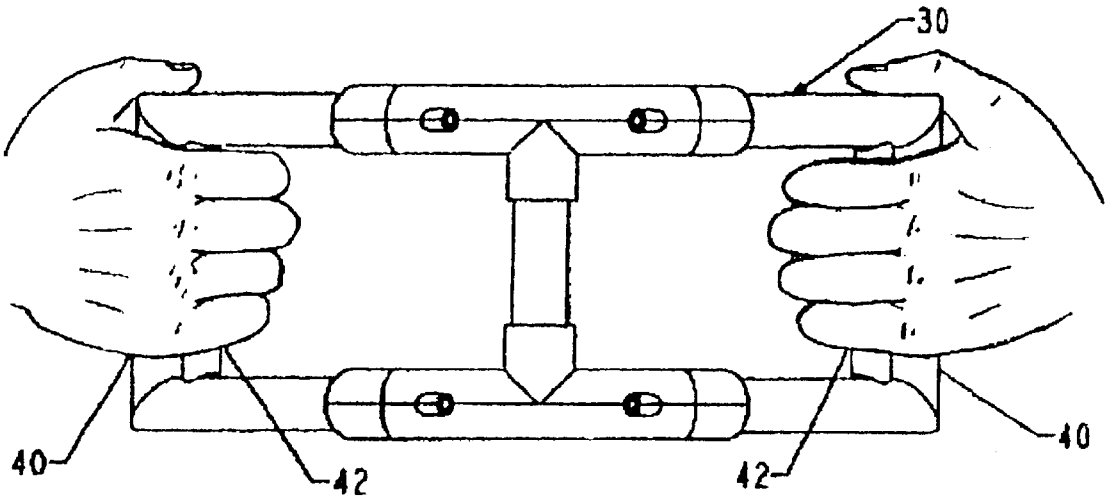
FIG. 20 shows the invention being used as a finger exerciser with the gripping posts compressed toward the outer posts.
Figure 21:
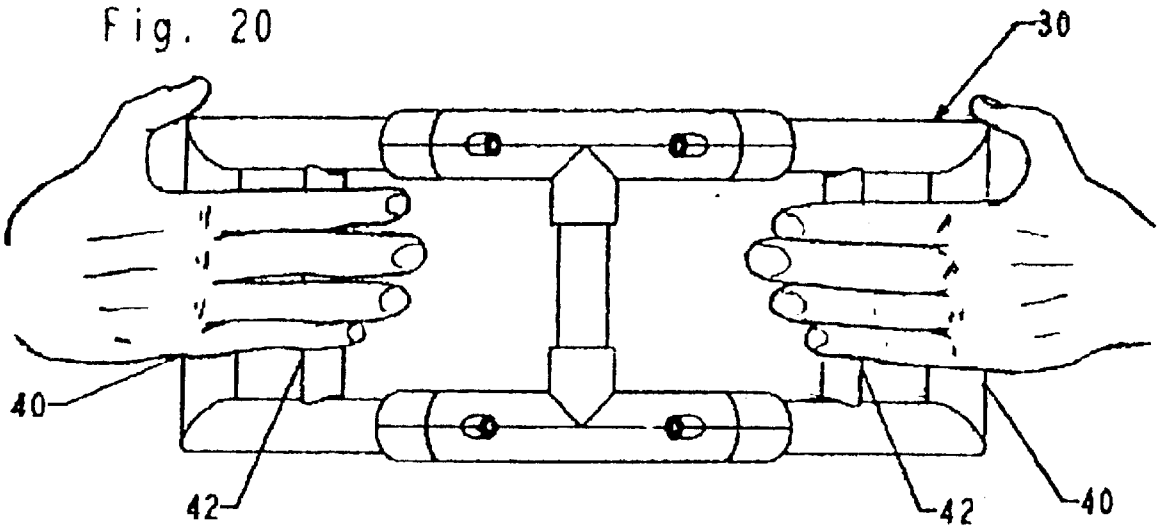
FIG. 21 shows the invention being used as a finger exerciser with the gripping posts released away from the outer posts.

As a finger exerciser and inner-forearm strengthener, the base of the thumb of each hand is held against the outer posts 40 while the fingers grasp around the gripping posts 42 as shown in FIG. 20. To execute the exercise, the fingers grip the gripping posts 42 and squeeze the gripping posts 42 toward the outer posts 40, FIG. 20; then the fingers release the gripping post 42, FIG. 21. A person performing the exercise repeats this sequence, i.e., alternately squeezing and releasing the gripping posts, with both hands until the exercise is complete. A person performing the exercise could exercise only one hand if he or she wishes.

Figures 22, 23:
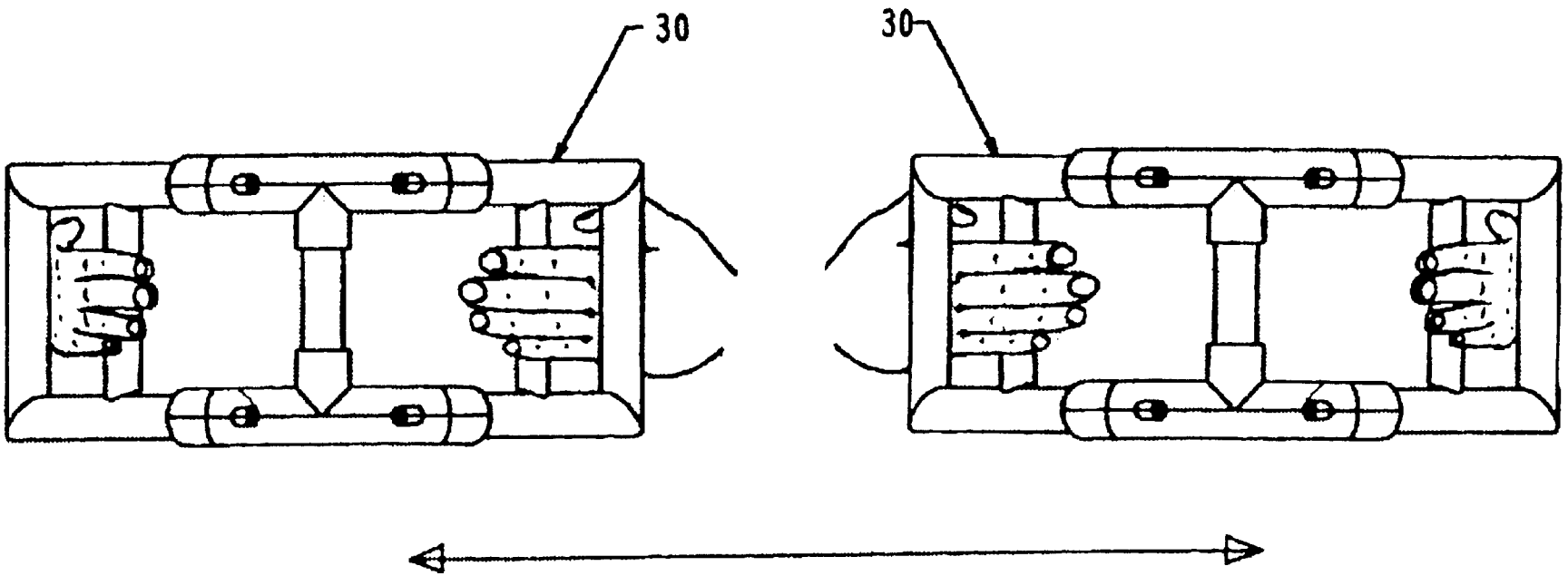
FIG. 22 shows a view of the invention being used as a wrist stretcher as positioned to the right side of the user.
FIG. 23 shows a view of the invention being used as a wrist stretcher as positioned to the left side of the user.

There are many exercises in which a person may use the hand and wrist exerciser to stretch the wrists and inner forearms:

In a first exercise, with the fingers extended, the fingers of both hands are inserted between the outer posts 40 and the gripping posts 42, FIGS. 22 and 23, with the palm side of the fingers against the gripping posts 42 and the back of the hand against the outer posts 40. Then, with the arms in front of the body and the elbows bent, the user moves the arms and hands to the left of the body then to the right of the body, alternately, in a horizontal motion to alternately stretch the wrists and the insides of the forearms of both arms as shown in FIGS. 22 and 23. This exercise forces one hand backwards toward the outer wrist, thereby stretching the wrist and inner forearm while the other hand relaxes. Each movement is alternated back and forth until the exercise is complete.

In a second exercise, with the fingers extended, the fingers of both hands are inserted between the outer posts and the gripping posts with the palm side of the fingers against the gripping posts and the back of the hand against the outer posts, not shown. Then, with the arms in front of the body and the elbows extended, the user moves the arms and hands to the left of the body then to the right of the body, alternately, in a horizontal motion to alternately stretch the wrists, the insides of the forearms, and the muscles of the upper arms, not shown. Each movement is alternated back and forth until the exercise is complete.

In a third exercise, with the fingers extended, the fingers of both hands are inserted between the outer posts and the gripping posts with the palm side of the fingers against the gripping posts and the back of the hand against the outer posts, not shown. Then, with the arms held in back of the body and the elbows extended, the user moves the arms and hands to the left of the body then to the right of the body, alternately, in a horizontal motion to alternately stretch the wrists, the insides of the forearms, and the upper thighs, not shown. Each movement is alternated back and forth until the exercise is complete.

In a fourth exercise, with the fingers extended, the fingers of both hands are inserted between the outer posts and the gripping posts with the palm side of the fingers against the gripping posts and the back of the hand against the outer posts, not shown. Then, with the arms held overhead and the elbows extended, the user moves the arms and hands down to the left of the body then down to the right of the body, alternately, in a semicircular motion to alternately stretch the wrists, the insides of the forearms, and the lower torso, not shown. Each movement is alternated back and forth until the exercise is complete.

In a fifth exercise, with the fingers extended, the fingers of both hands are inserted between the outer posts and the gripping posts with the palm side of the fingers against the gripping posts and the back of the hand against the outer posts, not shown. Then, with the arms held overhead and the elbows extended, the user moves the arms and hands overhead in a continuous clockwise motion then in a continuous counterclockwise motion, alternately, to stretch the wrists, the insides of the forearms, and the lower torso, not shown. Each movement is alternated back and forth until the exercise is complete.

It should be understood that the drawings submitted herewith are not always drawn exactly to scale, but all drawings submitted are presented to accurately illustrate the functional features of this invention.

While the present invention has been disclosed in connection with the preferred embodiment thereof, it should be understood that there may be other embodiments which fall within the spirit and scope of the invention as defined by the following claims.

I claim:

1. A hand and wrist exerciser, comprising:

an outer frame further comprising, left and right outer posts, which are mirror images of each other, and upper and lower members, which are mirror images of each other, connected to the left and right outer posts having an intermediate portion, defined by corners formed on the upper and lower members, configured such that said left and right outer posts extend outwardly from the intermediate portion at an angle of less than 180 degrees, said upper and lower members forming an arch thereby, and the upper member having slots on the lower side thereof and the lower member having slots on the upper side thereof;

a pair of gripping posts slidably connected to the upper and lower members having bars inserted therethrough which enable said gripping posts to slide through the slots of said upper and lower members toward the outer posts in one direction but which are prevented from sliding in the other direction by ends of the slots; and biasing means to bias each of the gripping posts toward the intermediate portion whereby a user can place fingers around a gripping post with the base of the thumb held against an outer post and squeeze said gripping post toward said outer post for one exercise and place the fingers of each hand between a gripping post and an outer post and move the hand and wrist exerciser back-and-forth in a horizontal direction for another exercise.

2. A hand and wrist exerciser, according to claim 1, wherein the biasing means are tension springs, two springs residing within the upper member and two springs residing within the lower member, said upper and lower members having pins inserted therethrough, two pins each inserted through the upper member near the corners thereof and two pins each inserted through the lower member near the corners thereof, each tension spring having one end attached to a pin and the other end attached to a bar inserted in a gripping post.

3. A hand and wrist exerciser, according to claim 1, wherein the biasing means are tension springs installed within the upper and lower members said tension springs having means to adjust the tension thereof.

4. A hand and wrist exerciser, according to claim 3, wherein the means to adjust the tension of the tension springs comprises screws inserted into the upper and lower members near the corners thereof each screw attaching to a metal angle, which itself is attached to a tension spring, and which when screwed in one direction increases the tension on said tension spring and when screwed in the other direction releases the tension on said tension spring.

5. A hand and wrist exerciser, according to claim 3, wherein the means to adjust the tension of the tension springs comprises screws inserted into the upper and lower members near the corners thereof each screw attaching to a swivel, which itself is attached to a tension spring, and which when screwed in one direction increases the tension on said tension spring and when screwed in the other direction releases the tension on said tension spring.

6. A hand and wrist exerciser, according to claim 3, wherein the means to adjust the tension of the tension springs comprises:

bolts inserted into the upper and lower members near the corners thereof each bolt attaching to a tension adjusting plate, which itself is threaded through the coils of a tension spring which when screwed in one direction increases the tension on said tension spring and when screwed in the other direction releases the tension on said tension spring.

7. A method for stretching the wrists and inner forearms, comprising the steps of:

obtaining a hand and wrist exerciser having an outer frame further comprising, left and right outer posts, which are mirror images of each other, and upper and lower members, which are mirror images of each other, connected to the left and right outer posts having an intermediate portion, defined by corners formed on the upper and lower members, configured such that said left and right outer posts extend outwardly from the intermediate portion at an angle of less that 180 degrees, said upper and lower members forming an arch thereby, and the upper member having slots on the lower side thereof and the lower member having slots on the upper side thereof, a pair of gripping posts slidably connected to the upper and lower members having bars inserted therethrough which enable said gripping posts to slide through the slots of said upper and lower members toward the outer posts in one direction but which are prevented from sliding in the other direction by ends of the slots, and biasing means to bias each of the gripping posts toward the intermediate portion whereby a user can place fingers around a gripping post with the base of the thumb held against an outer post and squeeze said gripping post toward said outer post for one exercise and place the fingers of each hand between a gripping post and an outer post and move the hand and wrist exerciser back-and-forth in a horizontal direction for another exercise;

with the fingers extended, placing the fingers of each hand between the gripping posts and the outer posts with the palm side of the fingers against the gripping posts and the back of each hand against the outer posts;

performing an exercise to stretch the wrists and inner forearms.

8. A method for stretching the wrists and inner forearms, according to claim 7, wherein the exercise to stretch the wrists and inner forearms, further comprises the steps of:

with the arms in front of the body and the elbows bent, moving the hand and wrist exerciser to the left of the body;

with the arms in front of the body and the elbows bent, moving the hand and wrist exerciser to the right of the body; and repeating both the moving actions, alternately, until the exercise is complete.

9. A method for stretching the wrists and inner forearms, according to claim 7, wherein the exercise to stretch the wrists and inner forearms, further comprises the steps of:

with the arms in front of the body and the elbows extended, moving the hand and wrist exerciser to the left of the body;

with the arms in front of the body and the elbows extended, moving the hand and wrist exerciser to the right of the body; and repeating both the moving actions, alternately, until the exercise is complete.

10. A method for stretching the wrists and inner forearms, according to claim 7, wherein the exercise to stretch the wrists and inner forearms, further comprises the steps of:

with the arms held in back of the body and the elbows extended, moving the hand and wrist exerciser to the left of the body;

with the arms held in back of the body and the elbows extended, moving the hand and wrist exerciser to the right of the body; and repeating both the moving actions, alternately, until the exercise is complete.

11. A method for stretching the wrists and inner forearms, according to claim 7, wherein the exercise to stretch the wrists and inner forearms, further comprises the steps of:

with the arms held overhead and the elbows extended, moving the hand and wrist exerciser down to the left of the body;

with the arms held overhead and the elbows extended, moving the hand and wrist exerciser down to the right of the body; and repeating both the moving actions, alternately, until the exercise is complete.

12. A method for stretching the wrists and inner forearms, according to claim 7, wherein the exercise to stretch the wrists and inner forearms, further comprises the steps of:

with the arms held overhead and the elbows extended, moving the hand and wrist exerciser in a continuous clockwise motion;

with the arms held overhead and the elbows extended, moving the hand and wrist exerciser in a continuous counterclockwise motion; and repeating both the moving actions, alternately, until the exercise is complete.

* * * * *